US005404770A

United States Patent [19]

Krüger

[11] Patent Number: 5,404,770

[45] Date of Patent: Apr. 11, 1995

[54] VARIABLE CAM ARRANGEMETN FOR A LIFT VALVE

[75] Inventor: Hermann Krüger, Wolfsburg, Germany

[73] Assignee: Volkswagen AG, Wolfsburg, Germany

[21] Appl. No.: 74,220

[22] Filed: Jun. 9, 1993

Related U.S. Application Data

[62] Division of Ser. No. 922,984, Jul. 29, 1992, abandoned.

[30] Foreign Application Priority Data

Aug. 14, 1991 [DE] Germany ..... 41 26 832.6

[51] Int. Cl.[6] ..... F01L 1/34; F01L 1/04; F16H 53/00

[52] U.S. Cl. ..... 74/568 R; 74/567; 123/90.17; 123/90.60; 29/888.1

[58] Field of Search ..... 74/567, 568 R, 568 FS; 123/90.17, 90.16, 90.15, 90.6; 29/888.1

[56] References Cited

U.S. PATENT DOCUMENTS

| | | | |
|---|---|---|---|
| 4,870,872 | 10/1989 | Parsons | 123/90.17 |
| 4,886,022 | 12/1989 | Nakai | 123/90.17 |
| 5,056,477 | 10/1991 | Linder et al. | 123/90.17 |
| 5,056,478 | 10/1991 | Ma | 123/90.17 |
| 5,103,779 | 4/1992 | Hare | 123/90.16 X |
| 5,105,679 | 4/1992 | Voigt | 74/567 |
| 5,148,783 | 9/1992 | Shinkai et al. | 123/90.17 X |
| 5,168,772 | 12/1992 | Adamis et al. | 74/568 R |
| 5,307,768 | 5/1994 | Beier et al. | 74/568 R |

FOREIGN PATENT DOCUMENTS

| | | | |
|---|---|---|---|
| 3234639 | 3/1984 | Germany | 123/90.17 |
| 3720947 | 1/1988 | Germany | 123/90.17 |
| 412251 | 1/1992 | Germany | 123/90.17 |
| 4204048 | 1/1993 | Germany | 123/90.17 |
| 58-133409 | 9/1983 | Japan | 123/90.17 |
| 59-155514 | 4/1984 | Japan | 123/90.17 |
| 60-70108 | 4/1985 | Japan | 29/888.1 |
| 2-277913 | 11/1990 | Japan | 123/90.17 |
| 1537929 | 1/1990 | U.S.S.R. | 74/568 R |
| 91/02374 | 7/1992 | WIPO | 123/90.17 |

*Primary Examiner*—Vinh T. Luong
*Attorney, Agent, or Firm*—Brumbaugh, Graves, Donohue & Raymond

[57] ABSTRACT

A variable cam arrangement for a lift valve includes a cam having a rigid part which is movable on a camshaft in a radial direction between a retracted and an extended position, the movable part being guided on the camshaft, and stops on the camshaft and the movable part to limit the motion of the part.

3 Claims, 4 Drawing Sheets

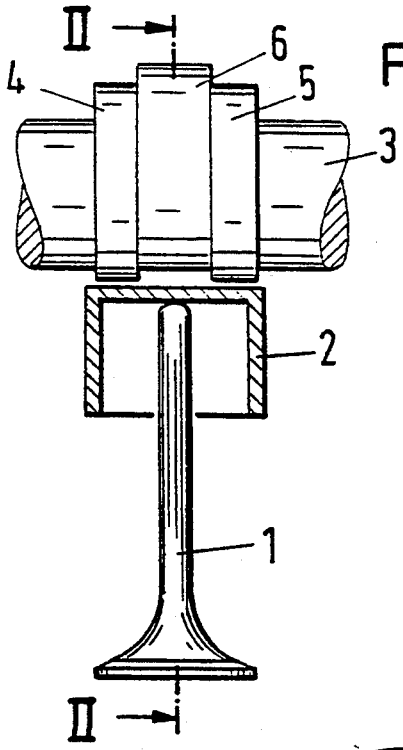
Fig. 1
Fig. 2
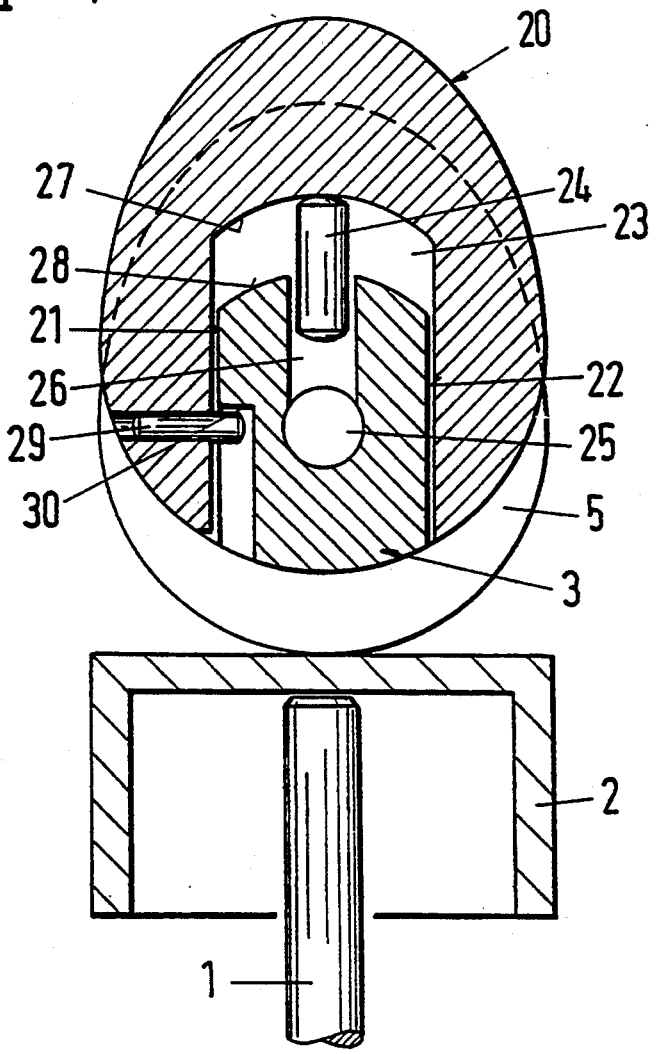

VARIABLE CAM ARRANGEMETN FOR A LIFT VALVE

This application is a division of application Ser. No. 07/922,984, filed on Jul. 29, 1992, abandoned.

BACKGROUND OF THE INVENTION

This invention relates to variable cam arrangements for lift valves of the type used, for example, in internal combustion engines.

In conventional valve actuation arrangements for the combustion chamber valves of internal combustion engines for motor vehicles, it is known that, for optimum operation of the engine under a variety of load and speed ranges, the valve lift curves, that is, the valve open times and the maximum lift of the valves, should be variable. For this purpose, cam arrangements are known with devices positioned between a valve cam and a valve, which consequently increase the oscillating mass, as well as cams which are pivotable on a camshaft to a limited extent and which only vary the valve open time. Unless additional measures are adopted, these valve lift arrangements tend to generate noise. German Offenlegungsschrift 37 05 128 also discloses camshaft arrangements with radially adjustable cams. These arrangements include a cam having a rigid part, referred to as a displaceable slide, which is adjustable in its radial position by a control rod extending through the camshaft and an endless steel band enclosing the control rod and the rigid part and providing the cam contour. By axial displacement of the control rod, the radial position of the displaceable slide can be controlled and, at the same time, both the cam lift and the shape of the cam flanks can be varied by appropriate deformation of the steel band.

Such a cam construction has the disadvantage that it cannot adjust only the flank shape of the cam or only the maximum cam lift. In addition, a steel band which has only point support from the slide and is unsupported in other regions is hardly able to withstand the forces acting upon a cam without damage, particularly after prolonged periods of operation.

SUMMARY OF THE INVENTION

Accordingly, it is an object of the present invention to provide a variable cam arrangement for a lift valve which overcomes the above-mentioned disadvantages of the prior art.

Another object of the invention is to provide a variable cam arrangement giving a large degree of freedom of variability of the lift curve of the associated valve and which also has a durable construction.

These and other objects are attained according to one aspect of the invention by providing a variable cam arrangement which includes a fixed cam part producing a minimum valve lift and open time and a variable cam part having a rigid member which is radially displaceable between a retracted position in which its periphery is within the periphery of the fixed cam part and an extended position in which its periphery projects beyond the periphery of the fixed cam part, and cooperating stops associated with the radially displaceable member and the cam shaft to limit radial motion of the displaceable member.

In a specific embodiment, the cam arrangement also includes at least one additional fixed part producing the minimum valve lift in addition to the part associated with the radially adjustable cam member. As soon as the mode of operation of the engine requires a change from the valve lift curve provided by the fixed cam member, the rigid displaceable member is extended radially so that its periphery which provides the cam surface at least partially projects radially beyond the periphery of the minimal cam and thereby determines the lift curve of the valve. It is also possible either to position the rigid displaceable member of the variable cam device only in a retracted position in which only the fixed cam surface is operative or in a fully-extended position with no intermediate settings, or to provide intermediate positions for the displaceable part which depend on operating parameters of the associated engine so that both cams are partially operative.

The provision of two cams permits the cam flanks to be provided with approach ramps arranged to minimize noise generation.

According to another aspect of the invention, the variable valve arrangement may be used independently of the presence of another fixed cam member providing the minimum lift and open times if the radially displaceable cam part encloses the camshaft on all sides. If the action which produces radial extension of the rigid part is shut off, the slidable part of the variable cam arrangement will keep moving back and forth in response to the force of the lift valve restoring spring. It is also possible, however, to cause the rigid slidable part of the cam to be positioned in different radial positions according to the crank angle by applying suitable actuating forces.

BRIEF DESCRIPTION OF THE DRAWINGS

Further objects and advantages of the invention will be apparent from a reading of the following description in conjunction with the accompanying drawings, in which:

FIG. 1 is a side view showing a representative variable cam arrangement according to the invention;

FIG. 2 is a sectional view of the embodiment shown in FIG. 1, taken the line II—II thereof;

DESCRIPTION OF PREFERRED EMBODIMENTS

Figure 3:
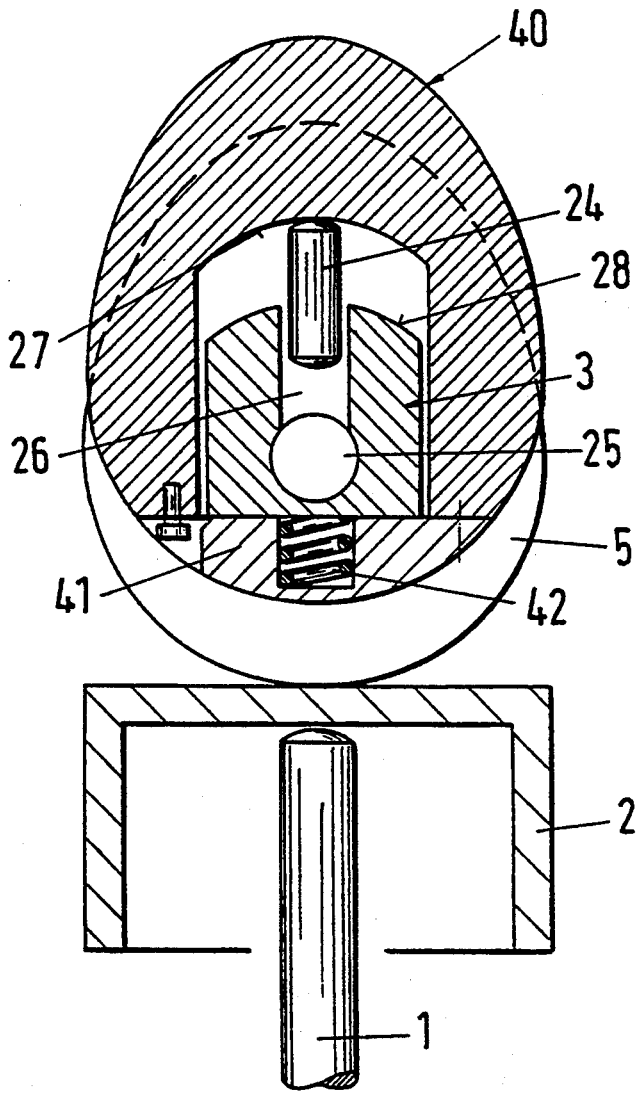
FIG. 3 is a similar sectional view showing another typical embodiment of the invention.

Referring first to the representative embodiment shown in FIG. 1, a lift valve 1 to be actuated by a cam, for example, a combustion chamber intake or exhaust valve of an internal combustion engine, has a conventional return spring (not shown). The lift valve 1 is acted upon through a tappet 2 by a cam arrangement comprising three cams 4, 5 and 6 which are rotationally fixed on a camshaft 3. Two of the cams 4 and 5 have the same shape, while the cam 6 is a variable cam having a radially displaceable part which permits alteration of the valve lift curve.

The embodiments illustrated in the other figures involve variations in the configuration of the cam 6.

As shown in FIG. 1, the cam 6 includes a rigid part 20 which is mounted on the camshaft 3 so as to be radially displaceable along parallel guide surfaces 21 and 22 formed on the camshaft. Thus, the part 20 embraces the camshaft 3 in a U-shaped manner, engaging the guide surfaces 21 and 22 and forming a chamber 23 therewith, into which a billet 24 projects. The force applied to the billet 24 by a pressure medium supplied through a lengthwise camshaft passage 25 and a transverse camshaft passage 26 which receives the billet urges the billet against the facing inner surface 27 of the rigid part 20. When there is little or no pressure in the transverse passage 26, the force applied to the outer surface of the cam resulting from the valve closure spring causes the inner surface 27 of the rigid part and the opposing surface 28 of the camshaft to come together, eliminating the chamber 23. In that condition, the periphery of the rigid part 20 will be substantially entirely radially within the periphery of the cam 5, which therefore will essentially determine the valve lift curve. As soon as the operating parameters of the engine require a departure from the minimal valve lift curve which is produced by the cam 5, the pressure in the transverse passage 26 is raised so that the billet 24 is extended and forces the part 20 into its extended position, shown in FIG. 2, in which the periphery of the part 20 projects radially beyond the periphery of the cam 5, so that the valve lift curve is now determined by the periphery of the part 20. This extended position is limited by a stop pin 29 mounted in the part 20, which cooperates with an abutment formed by a shoulder 30 at the end of a corresponding slot in the camshaft.

The embodiment shown in FIG. 3 also includes at least one fixed cam 5 in addition to a radially adjustable cam described hereinafter. As in the embodiment shown in FIG. 1, hydraulic pressure is provided for radial adjustment of a rigid part 40 which forms a variable cam and the billet 24, displaceable in response to pressure in the transverse passage 26, engages the inner surface 27 of the rigid part 40. In this embodiment, however, the movable portion has a bridge-like part 41, which is connected to the rigid part 40 by screws and limits the radial extending motion of the part 40. In the bridge-like part 41, there is a compression spring 42 which urges the rigid part 40 toward its radially retracted position. As a result, when the pressure in the transverse passage 26 is shut off, the spring 42 renders the rigid part 40 essentially inoperative so far as contribution to the valve lift curve is concerned.

At this point, it should be noted that, while the particular embodiments described herein operate with hydraulic actuation, which is advantageous in view of the fact that an oil circuit is available in combustion engines, alternative actuating arrangements may be used for displacement of the rigid part, such as pneumatic, magnetic or centrifugal operating actuating arrangements. One advantage of the invention is that it permits very different variable cam configurations according to particular needs.

This is also shown by FIGS. 4–8 which illustrate several possible valve lift curve variations. In these figures, the valve lift V is plotted against the camshaft angle w. Solid lines m represent the minimum lift curve as defined by the minimal cam periphery. When the variable cam 6 becomes operative, that is, when the movable rigid part is radially extended, the dash-dotted valve lift curves n shown in FIGS. 4–7 are produced.

Figure 4:
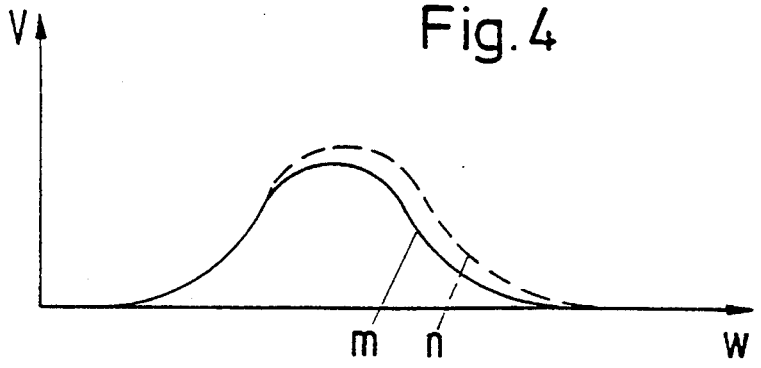
FIG. 4, 5, 6 and 7 are graphical representations showing various lift curves for a valve having a variable cam arrangement according to the invention.
Figure 5:
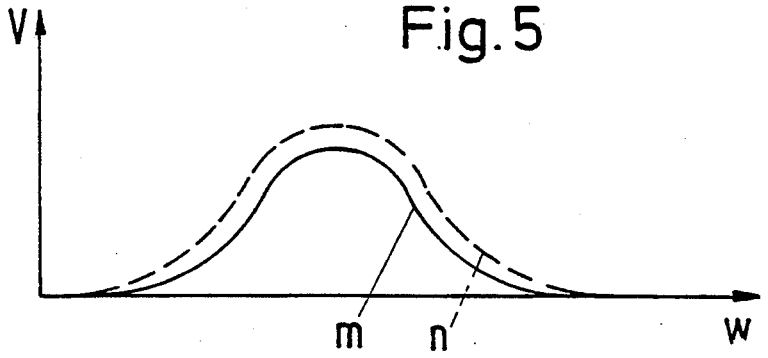
Figure 6:
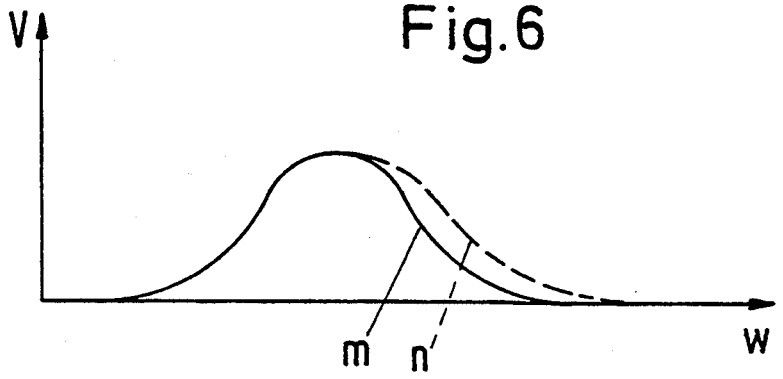
Figure 7:
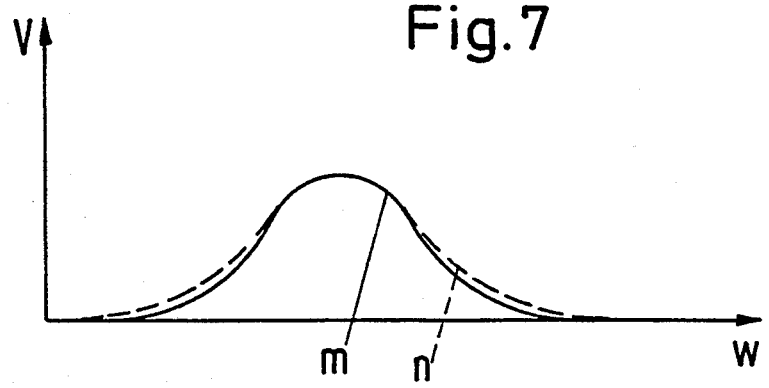

In FIG. 4, the variable cam is so designed that it provides an augmented lift and a delayed valve closure relative to the minimum lift curve m. In FIG. 5, the shape of the movable rigid part and hence of the variable cam is such that the valve lift curve n generated by it lies completely above the minimal curve m, so that the time of opening is advanced as well. FIG. 6, on the other hand, shows a curve n based on a configuration of the variable cam that results only in a shift of the time of valve closure to a later point, whereas in FIG. 7 the valve lift curve n is spread out relative to the minimal curve m with no change in valve lift.

Figure 8:
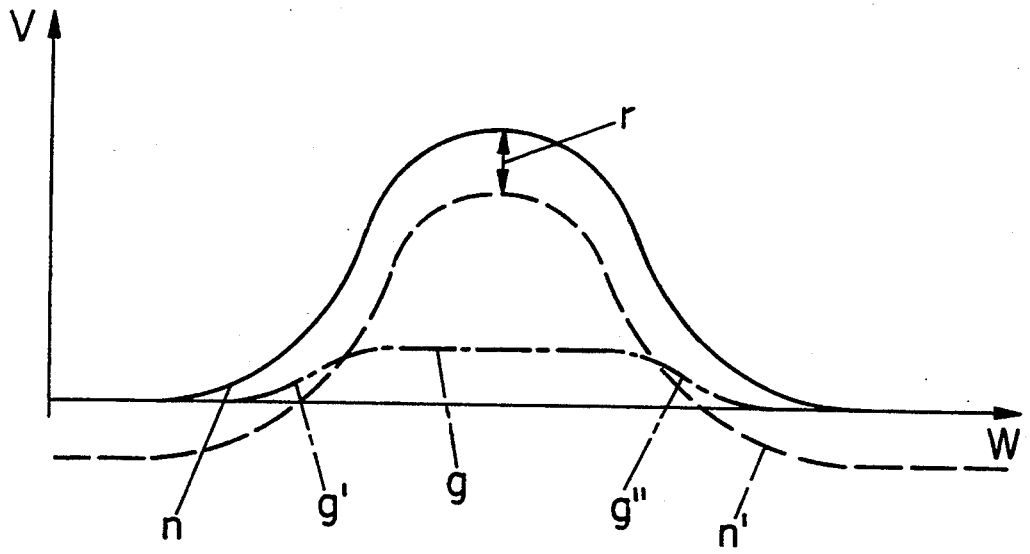
FIG. 8 is a graphical representation showing representative valve lift curves provided by special cam shapes according to the invention.

FIG. 8 shows a curve produced by a variable cam having a rigid part capable of being extended and maintained in intermediate positions as well as the fully-extended position. In the fully-extended state, the valve lift curve n is produced, and between the withdrawn and retracted position of the movable rigid part, which produces the curve n′, and the extended position, which produces the curve n, there is a control range r for the maximum valve lift. In this construction, the valve lift and the times of opening and closing of the valve vary simultaneously. The overall cam arrangement comprises a root circle, indicated by the dash-dotted curve g, which is preferably provided by a fixed cam next to the variable cam on the camshaft. In the regions where the engagement of the variable cam begins and ends, designated g′ and g″, the root circle g provides ascending and descending ramp elevations to assure impact-free and noiseless operation of the cam.

Figure 9:
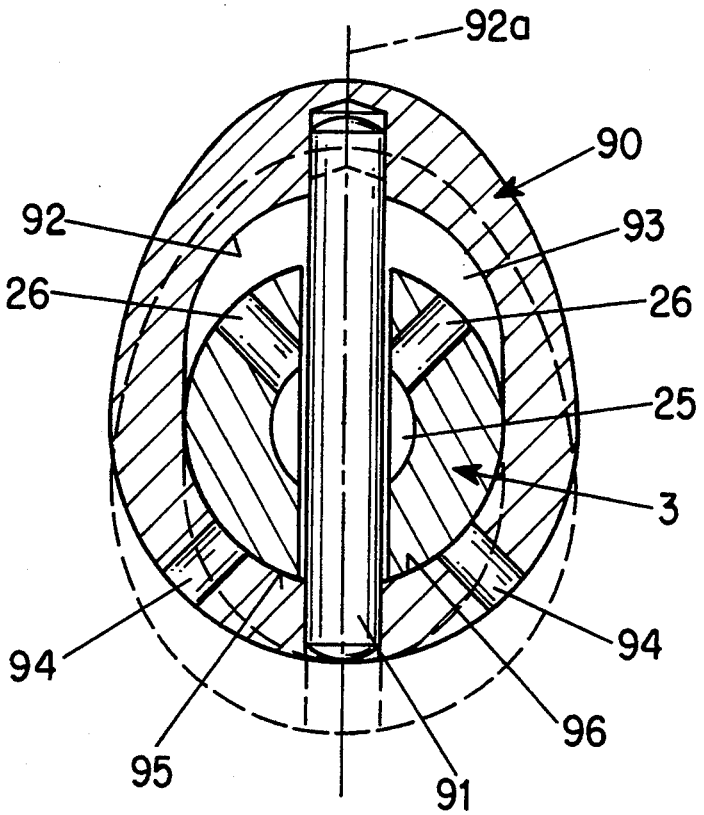
FIG. 9 is a sectional view similar to FIG. 2 showing another embodiment of the invention.

Finally, in the embodiment shown in FIG. 9, the camshaft 3 has a lengthwise passage 25 and two radial passages 26. In this case, the camshaft is not shaped with guide surfaces for a movable rigid part 90 which forms the variable cam. Instead, the movable part surrounds the camshaft on all sides, but a guide pin 91 mounted in the movable part extends through the camshaft. To accommodate the camshaft 3, the movable rigid part 90 is formed with an oblong aperture 92, oriented so that its lengthwise centerline **92*a* coincides with that of the guide pin 91. The oblong aperture 92, together with a peripheral region of the camshaft 3 in the upper part as seen in the drawing, which has the two radial passages 26, form an omnilateral sealed, crescent-shaped pressure chamber 93. In the lower part of the movable rigid part 90 as seen in the figure, there are two vent holes 94** which serve to fill or vent the chamber formed between the movable part and the camshaft when the movable part is displaced downwardly as viewed in the drawing.

If there is no fixed cam 5 used in conjunction with the variable cam of FIG. 9, then axial displacement of the movable part 19 will vary both the valve lift and opening and closing times of the valve. In the relative position of the part 90 and the camshaft 3 shown in the drawing, in which the facing peripheral surface regions 95 and 96 of these two parts are in contact, there is a relatively high pressure in the chamber 93, indicating the existence of operating parameters of the engine that demand a large and prolonged opening of the valve. On the other hand, if the upper chamber 93 is depressurized, a repeated back-and-forth motion of the part 90 along the guide pin 91 between the positions shown in solid lines and dashed outline in FIG. 9 will occur in response to the valve spring during rotation of the camshaft, thereby generating a minimal lift curve.

If desired, however, this construction of the variable cam can be used in combination with a fixed cam.

The invention thus provides a variable cam arrangement for a lift valve which assures a large degree of freedom regarding variation of the valve lift curve, and which also permits an optimal design arrangement for any particular case.

Although the invention has been described herein with reference to specific embodiments, many modifications and variations therein will readily occur to those skilled in the art. Accordingly, all such variations and modifications are included within the intended scope of the invention.

I claim:

1. A variable cam arrangement for a lift valve comprising a camshaft, cam means rotationally fixed on the camshaft including a rigid cam part supported for radial displacement with respect to the camshaft for the purpose of varying the valve lift curve, wherein the rigid part surrounds the camshaft and has an oblong aperture through which the camshaft passes and including a guide pin extending through the camshaft parallel to the lengthwise centerline of the oblong aperture to serve as a guide for radial motion of the rigid part.

2. A variable cam arrangement according to claim 1 wherein the camshaft and the rigid part have mutually facing surfaces which serve as stops.

3. A variable cam arrangement according to claim 1 wherein the oblong aperture in the rigid part encloses a crescent-shaped pressure space.

* * * * *

UNITED STATES PATENT AND TRADEMARK OFFICE

CERTIFICATE OF CORRECTION

PATENT NO. : 5,404,770

DATED : April 11, 1995

INVENTOR(S) : Hermann Krüger

It is certified that error appears in the above-indentified patent and that said Letters Patent is hereby corrected as shown below:

Title page, Item [54] and Column 1, first line, "ARRANGEMETN" should read --ARRANGEMENT--;

Title page, 2nd Column, 9th line, "412251" should read --4122251--;

Column 2, line 40, "taken" should read --taken on--.

Signed and Sealed this

Fourth Day of July, 1995

Bruce Lehman

BRUCE LEHMAN

*Commissioner of Patents and Trademarks*

*Attest:*

*Attesting Officer*